United States Patent [19]

Cole

[11] Patent Number: 4,837,861

[45] Date of Patent: Jun. 13, 1989

[54] FACIAL SPRAY GUARD

[75] Inventor: Evelyn Cole, Rt. 1, Box 340, Beckville, Tex. 75631

[73] Assignee: Evelyn Cole, Beckville, Tex.

[21] Appl. No.: 202,406

[22] Filed: Jul. 21, 1988

[51] Int. Cl.[4] ..... A61F 9/00

[52] U.S. Cl. ..... 2/9

[58] Field of Search ..... 2/8, 9

[56] References Cited

U.S. PATENT DOCUMENTS

| | | | |
|---|---|---|---|
| 1,492,196 | 4/1924 | Bergstrom | 2/49 R |
| 3,060,445 | 10/1962 | Brockman | 2/9 |
| 3,206,760 | 9/1965 | Santala | 2/9 |
| 3,328,806 | 7/1967 | Allegro | 2/9 |
| 3,488,772 | 1/1970 | Sturm | 2/9 |
| 3,602,913 | 9/1971 | Neese | 2/9 |
| 3,772,707 | 11/1973 | Alosi et al. | 2/9 X |
| 3,963,034 | 6/1976 | Runberg et al. | 2/9 X |

*Primary Examiner*—Werner H. Schroeder
*Assistant Examiner*—Jeanette E. Chapman

[57] ABSTRACT

A facial guard to protect the user's eyes, ears, and face from hair spray and the like, said guard manufactured from durable plastic, said plastic attainable in a variety of colors and molded into a thin, cup-shaped, paddle-like guard, and said guard having a reflector-type mirror, said mirror being congruent to said guard, and said mirror attached to the underneath, concaved side of said guard, said attachment being by means of gluing.

The guard is shaped to be congruous to said user's hairline. The guard's said mirror is for use by said user as a cosmetic aide.

3 Claims, 1 Drawing Sheet

FACIAL SPRAY GUARD

SUMMARY OF THE INVENTION

The main objective of my invention is to create a face and ear protector-type guard with a cosmetic mirror (optional), and more particularly a device used to protect the user's face and ears during the application of hair spray or the like.

The intent of the present invention is to form a protecting device that consists of a cup-shaped, paddle-like main piece, having a handle extending from it, with a reflector-type mirror (optional) glued to it, making up the whole device.

In short, according to the present invention there is provided a simple and handy device where-by a private user or a licensed operator of hair designs can readily apply hair spray, at will, to either the top or sides of the hair. The device is advantageously adapted for this general and universal type and character of handy employment, and is durable, long lasting and inexpensive to manufacture.

DESCRIPTION OF THE DRAWING

Referring to the subject matter which I regard as my invention consists in the construction and novel combination and arrangenent of two parts fully described and illustrated in the accompanying drawings and pointed out in the claims hereto appended, it being understood that minor changes in the size or dimensions as discribed in this application, while remaining within the scope of the claims, may be resorted to without departing from the spirit of the invention, which includes an optional mirror.

Figure 1:
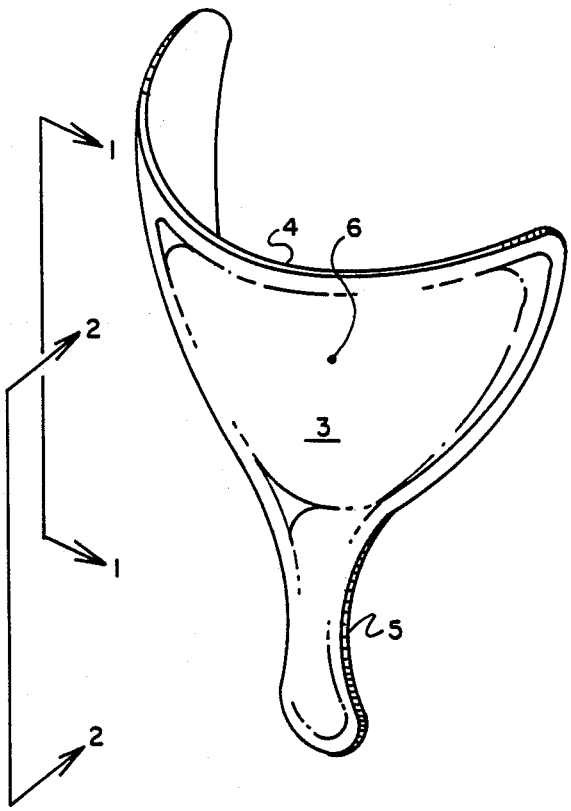
FIG. 1 shows an overall view of the guard having a concave and a convex side and also having two side edges and one top edge.
Figure 2:
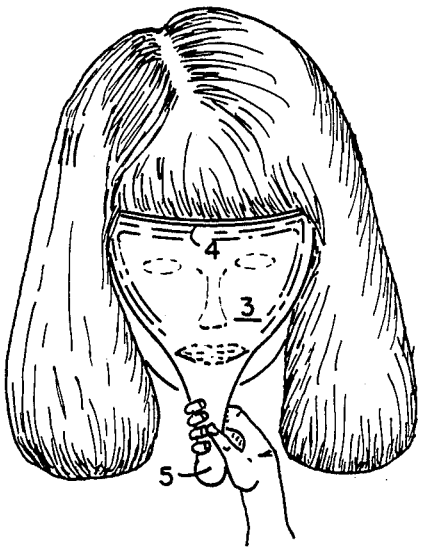
FIG. 2 shows the guard in use over the forehead.
Figure 3:
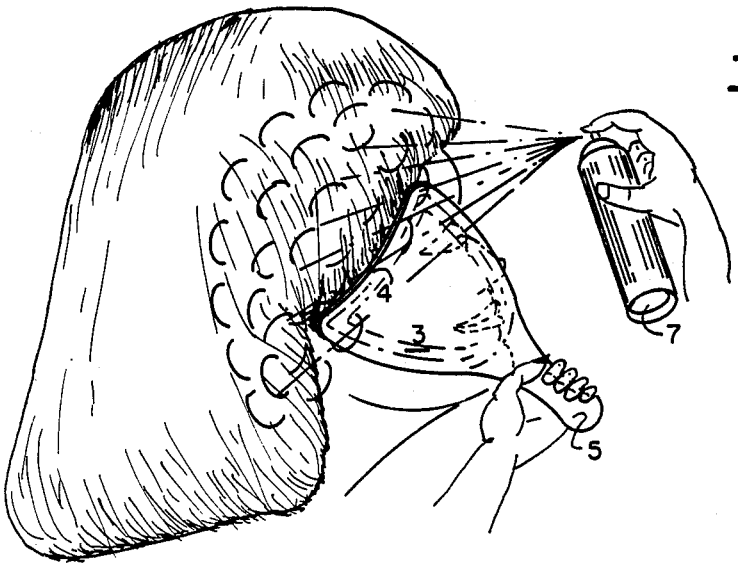
FIG. 3 shows the guard in use on the side of the face and over the ear. Numeral 1 designates a vertical side view of the guard. numeral 2 designates a vertical front view of the guard. The guard is designated as numeral 3. Numeral 4 is the uppermost edge of the guard which fits against the forehead or side of the face as shown in FIGS. 2 and 3. Numeral 5 indicates the handle. Numeral 6 designates where an optional mirror will be attached to the underneath, concaved side of the guard. Numeral 7 denotes a can of hair spray.

I claim:

1. A face and ear guard used to protect the user's face, ears or eyes during the application of hair spray or the like, said guard comprising:

a paddle like main piece having concave and convex sides and having two side edges and one top edge, a handle extending from said main piece, and a reflector type mirror affixed to said concave side of said main piece.

2. The guard of claim 1 wherein the mirror extends to the outer edges of the guard but stops short of the handle

3. The guard of claim 1, being constructed of one piece of thin yet durable plastic

* * * * *